US008479932B2

(12) United States Patent
Carney

(10) Patent No.: US 8,479,932 B2
(45) Date of Patent: Jul. 9, 2013

(54) TENSION ROD

(75) Inventor: John R. Carney, Bentleyville, OH (US)

(73) Assignee: Interdesign, Inc., Solon, OH (US)

( * ) Notice: Subject to any disclaimer, the term of this patent is extended or adjusted under 35 U.S.C. 154(b) by 72 days.

(21) Appl. No.: 13/068,354

(22) Filed: May 9, 2011

(65) Prior Publication Data

US 2012/0285914 A1 Nov. 15, 2012

(51) Int. Cl.

| | |
|---|---|
| ***A47H 1/08*** | (2006.01) |
| *E04G 25/08* | (2006.01) |
| *F16B 7/10* | (2006.01) |

(52) U.S. Cl.

USPC ..... 211/105.5; 248/200.1; 403/109.5; 403/304

(58) Field of Classification Search

USPC ..... 211/105.1, 105.2, 105.3, 105.4, 123, 211/175, 182, 204, 205, 206; 248/159, 251, 248/253, 257, 261, 263, 265, 298.1, 354.1, 248/200.1, 644; 403/109.1, 109.2, 109.3, 403/109.4, 109.5, 292, 296, 344, 369, 370, 403/304

See application file for complete search history.

(56) References Cited

U.S. PATENT DOCUMENTS

| | | | | |
|---|---|---|---|---|
| 468,987 | A | 2/1892 | Lingley et al. | |
| 519,840 | A | 5/1894 | Edsall | |
| 520,584 | A * | 5/1894 | Turner | 211/105.4 |
| 536,272 | A | 3/1895 | Edsall | |
| 645,543 | A | 3/1900 | Birch | |
| 647,986 | A | 4/1900 | Roberts | |
| 670,585 | A | 3/1901 | Fowler | |
| 961,352 | A | 6/1901 | Walters | |
| 704,403 | A | 7/1902 | Thill | |
| 841,062 | A | 1/1907 | Snyder et al. | |
| 856,316 | A | 6/1907 | Thurston | |
| 988,200 | A | 3/1911 | Logsdon | |
| 1,140,570 | A | 5/1915 | Buckley | |
| 1,178,994 | A | 4/1916 | Crump | |
| 1,425,247 | A | 8/1922 | Galbreath | |
| 1,548,053 | A | 8/1925 | Mead | |
| 1,639,551 | A | 8/1927 | Booth | |
| 1,679,881 | A * | 8/1928 | Simpson | 211/105.4 |
| 2,032,842 | A | 3/1936 | Gould | |
| 2,079,267 | A | 5/1937 | Vroom | |

(Continued)

FOREIGN PATENT DOCUMENTS

| | | |
|---|---|---|
| CH | 625601 | 9/1981 |
| CN | 2349932 Y | 11/1999 |
| JP | 2055100 | 2/1990 |

*Primary Examiner* — Jonathan Liu

*Assistant Examiner* — Joshua Rodden

(74) *Attorney, Agent, or Firm* — D. Peter Hochberg; Sean F. Mellino

(57) ABSTRACT

A tension rod comprising in its preferred form an outer tube and an inner tube in a telescoping arrangement. The outer tube has an expansion joint structure which can engage the inner surface of the outer tube to hold it in place. A spring stem-wedge-rod structure has a wedge portion with a threaded rod extending therefrom for being threaded through a nut held in the expansion rod structure. The spring stem-wedge-rod structure has a stem extending through a coil spring, and a spring retainer is fixed both to the stem and to the inner tube. Twisting of the inner tube causes the wedge portion to effect the expansion joint structure to be fixed in the outer tube, and the coil spring provides the tension to mount the tension rod between a pair of opposing wall surfaces.

23 Claims, 8 Drawing Sheets

U.S. PATENT DOCUMENTS

| | | | | | |
|---|---|---|---|---|---|
| 2,199,851 | A | | 5/1940 | Culver | |
| 2,490,369 | A | * | 12/1949 | Neuwirth | 248/188.5 |
| 2,519,996 | A | | 8/1950 | Blake | |
| 2,526,415 | A | * | 10/1950 | Refsdal | 403/351 |
| 2,542,967 | A | * | 2/1951 | Waechter | 248/188.5 |
| 2,919,134 | A | | 12/1959 | Zuro | |
| 2,941,669 | A | * | 6/1960 | Palay et al. | 211/1.55 |
| 2,947,556 | A | * | 8/1960 | Wenger | 403/290 |
| 2,973,870 | A | | 3/1961 | Schoos | |
| 2,991,096 | A | * | 7/1961 | Davidson | 403/365 |
| 3,004,743 | A | * | 10/1961 | Wenger | 248/161 |
| 3,350,120 | A | | 10/1967 | Hinrichs | |
| 3,506,135 | A | | 4/1970 | Klingaman | |
| 3,521,758 | A | | 7/1970 | Guilfoyle, Sr. | |
| 3,560,032 | A | * | 2/1971 | Cohen et al. | 403/104 |
| 3,674,294 | A | * | 7/1972 | Kirkham | 403/104 |
| 3,952,877 | A | | 4/1976 | Kindl | |
| 4,037,726 | A | | 7/1977 | Schweers | |
| 4,147,199 | A | | 4/1979 | Cameron | |
| 4,419,026 | A | * | 12/1983 | Leto | 403/104 |
| 4,769,862 | A | | 9/1988 | Skrzelowski | |
| D331,872 | S | | 12/1992 | Maruko | |
| D337,495 | S | | 7/1993 | Alexander | |
| 5,242,065 | A | | 9/1993 | Hoban | |
| 5,330,061 | A | | 7/1994 | Geltz | |
| D372,963 | S | | 8/1996 | Luca, Jr. et al. | |
| D379,297 | S | | 5/1997 | Shires | |
| D388,693 | S | | 1/1998 | Luca, Jr. et al. | |
| D389,038 | S | | 1/1998 | Rosul | |
| 5,769,104 | A | * | 6/1998 | Uemura | 135/69 |
| D401,680 | S | | 11/1998 | Tiernan | |
| 5,876,147 | A | * | 3/1999 | Longo | 403/109.5 |
| D415,014 | S | | 10/1999 | Bruton | |
| 6,302,614 | B1 | * | 10/2001 | Tseng | 403/109.5 |
| D466,000 | S | | 11/2002 | Zetsche | |
| D466,399 | S | | 12/2002 | Jessee et al. | |
| D468,193 | S | | 1/2003 | Ohm et al. | |
| 6,516,821 | B1 | * | 2/2003 | Uemura | 135/75 |
| 6,550,728 | B1 | * | 4/2003 | Fuhrman | 248/188.5 |
| 6,595,226 | B2 | * | 7/2003 | Uemura | 135/75 |
| 6,651,831 | B2 | | 11/2003 | Samelson | |
| 6,824,000 | B2 | | 11/2004 | Samelson | |
| D516,901 | S | | 3/2006 | Murray | |
| D520,348 | S | | 5/2006 | Poulet | |
| D530,132 | S | | 10/2006 | Ivankovic | |
| D534,062 | S | | 12/2006 | van den Bosch | |
| D542,897 | S | | 5/2007 | Harwanko | |
| 7,229,101 | B2 | * | 6/2007 | Lenhart | 280/819 |
| D547,165 | S | | 7/2007 | Barrese | |
| D576,022 | S | | 9/2008 | Goldstein | |
| 8,215,863 | B2 | * | 7/2012 | Sohn | 403/109.5 |
| 2006/0156465 | A1 | | 7/2006 | Lavi et al. | |
| 2006/0204322 | A1 | * | 9/2006 | Roiser | 403/109.5 |
| 2006/0218717 | A1 | | 10/2006 | van den Bosch | |
| 2007/0284324 | A1 | | 12/2007 | Goldstein | |
| 2008/0156952 | A1 | | 7/2008 | Nathan | |
| 2008/0163418 | A1 | | 7/2008 | Barrese | |
| 2009/0101609 | A1 | | 4/2009 | Batshon | |
| 2010/0316438 | A1 | * | 12/2010 | Sohn | 403/109.1 |
| 2011/0243647 | A1 | * | 10/2011 | Sohn | 403/109.1 |
| 2012/0076572 | A1 | * | 3/2012 | Sohn | 403/109.1 |

* cited by examiner

TENSION ROD

BACKGROUND OF THE INVENTION

1. Field of the Invention

This invention relates to tension rods, and in particular to tension rods for expanding against opposite walls or other support surfaces for holding curtains, hangers or other articles in place on the tension rod.

2. Description of the Prior Art

Tension rods incorporating telescoping tubes for being installed between walls having different distances between them are well known in the art. Typical tension rods are known for hanging shower curtains. A number of such rods are known having long coil compression springs which are compressed as the telescoping tubes are pressed together and then released so the spring can expand and press the tubes against the walls. However, those rods show the least amount of tension force when the spring is in its expanded state when advantageously it should have its greatest strength, and show the highest tension force when the spring is in its compressed state. In some cases, threaded inner and outer rods are known. However, such of the rods often require a great number of rotations to get the desired length, and often cannot maintain a tight enough fit over time to maintain the rod in place, essentially under downwardly transverse loads. Such constructions are described in U.S. Pat. No. 704,403 (Thill), U.S. Pat. No. 2,079,267 (Vroom), U.S. Pat. No. 2,919,134 (Zuro) and U.S. Pat. No. 3,521,758 (Guilfoyle, Sr.). In some instances a biasing spring is combined with combinations of threaded rods, such as in U.S. Pat. No. 670,585 (Fowler), U.S. Pat. No. 856,316 (Thurston), U.S. Pat. No. 1,548,053 (Mead), U.S. Pat. No. 2,199,851 (Culver), CH 625601 (Baumann) and JP 2055100 (Wada), but these have not been found effective. Compression spring arrangements in tension rods are very well known, but involve a compromise in being reasonably easy to compress while providing sufficient holding force to keep the tension rod in place between opposing walls while the tension rod is under downward transverse loads. This type of tension rods area disclosed in U.S. Pat. No. 468,987 (Lingley et al.), U.S. Pat. No. 519,840 (Edsall), U.S. Pat. No. 536,272 (Edsall), U.S. Pat. No. 645,543 (Birch), U.S. Pat. No. 647,986 (Roberts), U.S. Pat. No. 841,062 (Snyder et al.), U.S. Pat. No. 961,352 (Walters), U.S. Pat. No. 988,200 (Logsdon), U.S. Pat. No. 1,140,570 (Buckley), U.S. Pat. No. 1,178,994 (Crump), U.S. Pat. No. 1,425,247 (Galbreath), U.S. Pat. No. 1,639,551 (Booth), U.S. Pat. No. 2,032,842 (Gould), U.S. Pat. No. 2,519,996 (Blake), U.S. Pat. No. 2,973,870 (Schoos), U.S. Pat. No. 3,350,120 (Hinrichs), U.S. Pat. No. 3,952,877 (Kindl), U.S. Pat. No. 4,6037,726 (Schweers), U.S. Pat. No. 4,147,199 (Cameron), U.S. Pat. No. 5,242,065 (Hoban) and U.S. Publication Nos. 2008/0156952 (Nathan) and 2009/0101609 (Batshon). A flexible threaded rod without a spring is disclosed in U.S. Pat. No. 5,330,601 (Geltz). Rods are also known which are initially put between opposing walls, and later tightened against those walls. This can be difficult to do where there is no easy access between the walls and may not produce a tight fit. Other tension rods exist where the rods tend to "walk" or slip as outward tension force is applied to the tension rods.

None of the foregoing patent disclosures discloses a compression coil spring in a tension rod which maintains nearly constant tension before, during and after the tension rod is installed. No tension rods are known where a compression spring is located in a holding device disposed in one of a pair of telescoping tubes, wherein the tubes are compressed using low manual force, then twisting one of the tubes to tightly lock the compression spring in place, and then releasing the tubes between the walls. The present invention lacks the shortcomings of the prior art, including long compression springs, compression springs whose springs vary from being relatively high when in a compressed state and relatively weak in an expanded state. The present invention in its preferred form is easy for the average person to compress when required for installation, as is not true for the tension rod having a flexible worm gear for providing the tension force rather than a spring. Tension rods according to the preferred embodiments of the present invention do not tend to "walk" or slip along the surface during installation.

SUMMARY OF THE INVENTION

An object of the present invention is to provide an improved tension rod which can be expanded in a quick and easy way against opposing surfaces to hold the tension rod in place.

Another object of the invention is to provide a tension rod which can be easily adjustable for different lengths, yet can hold the tension rod in place between opposing walls with sufficient tension force to remain immovable under ordinarily expected forces.

It is also an object to provide a tension rod which can be adjusted to desired lengths without putting undue strain on the component parts of the tension rod.

It is another object of the present invention to provide an improved spring-loaded tension rod where the spring force is equal and constant for any length of the tension rod.

It is yet still another object of the present invention to provide a tension rod which can be adjusted to desired lengths without requiring more than easy-to-apply manual force, and then to require higher but yet easy-to-apply manual force for the final adjustment of the length of the tension rod.

A further object is the provision of an improved tension rod which requires no tools for the installation or removal thereof.

It is also an object of the present invention to provide a tension rod incorporating a compression spring whose spring force remains nearly constant as the tension is adjusted for installation and after installation between opposing walls or between other support surfaces.

An additional object is to provide a tension rod which does not "walk" or slip along the walls during or after installation.

Also an object of the present invention is to provide a tension rod which does not scratch or otherwise mar or damage the surface of the walls between which it extends.

Another further object of the invention is to provide a tension rod on which it is easy to apply the necessary forces to achieve the desired length, yet does not involve the possible buckling of the rod during or after installation of the rod between opposing walls.

It is also another object to provide a tension rod with spring-force loads that can be changed depending on wall strength, such as between dry wall and tiled walls.

An additional object is to provide an improved tension rod requiring simple and few parts.

It is also an object of the present invention to provide an improved tension rod which does not require the user thereof to understand the mechanism to be able to properly use the tension rod.

A still other object is to provide a tension rod which does not require undue access for installing the tension rod between opposing surfaces.

A yet further object of the invention is to provide a tension rod to be capable of measuring distances for the proper operation of the rod.

A general object is to provide a tension rod which can be made efficiently and economically and which is effective and practical to use.

These objects are achieved by the invention described below. The invention in its preferred form comprises a tube structure having an outer tube and an inner tube in a partially telescoping arrangement. A biasing device, preferably in the form of a compression spring located in the tube structure, provides a biasing force that puts a tension force on the inner tube and the outer tube. An expansion joint structure is fixable within the outer tube having outwardly expanding members which are engageable with the inner surface of the outer tube to hold the expansion joint structure in place. A spring stem-wedge-rod structure has a stem for extending through the spring and a wedge portion having a threaded rod which is an adjustable expansion control device, and the wedge portion moves partially through the expansion joint structure under the control of the threaded rod. The wedge expands the expansion joint assembly to fix it in the outer tube, and to then fix the end of the compression spring. In another version of the invention, a cam expansion structure is used wherein a cam body is twisted with a twisting of the inner tube to force the cam collar against the inner surface of the outer tube to fix the cam expansion structure in the outer tube. To use the inventive tension rod, one pulls the tubes away from each other to thereby set the overall length of the tension rod to be just longer than the space between the walls or other support surfaces between which the tension rod is to be disposed. The tubes of the tension rod are twisted relative to each other to fix the expansion joint structure in the outer tube. The tension rod is then placed between the opposing walls. The tubes of the tension rod are then released, and the spring pushes the tubes away from each other, and the free ends of the tubes engage the respective walls and hold the tension rod in place. The latter effect does not require twisting of the tension rod against the wall with which it is engaged and avoids such problems as they exist with prior tension rods.

DETAILED DESCRIPTION OF THE PREFERRED EMBODIMENTS

The invention relates to tension rods, and comprises structure for locating a biasing device in the outer tube of a telescoping arrangement of an inner tube slidable in an outer tube, compressing the biasing device and fixing a biasing support structure at a predetermined location in the outer tube to enable the biasing device to expand the tubes to mount the tension rod between support surfaces. In its basic form, the invention includes a compressible biasing device which is preferably a compressible coil spring. The invention further has a biasing device support structure for initially being locatable at a predetermined position in the outer tube, assisting in the compression of the biasing device, and having members for fixing the biasing device support structure in the outer tube, after which the biasing device releasably mounts the tension rod in place. In its preferred form, the biasing device support structure is an expansion joint structure having resilient leaves for initially locating the expansion joint structure in place due to a manual adjustment of the outer and inner tubes. A set of expansion members are subsequently urged against the inner surface of the outer tube to fix the expansion joint structure at the predetermined location in the outer tube. A fixing structure cooperates with the biasing device support structure to compress the biasing device and to fix the latter structure in the outer tube. According to the preferred form of the invention, the fixing structure activates a fixing structure actuating device, the latter device being a spring stem-wedge-rod structure having a wedge from which extends a threaded rod for being screwed into a nut contained in the expansion joint structure, and a stem for extending through the coil spring. The includes a fixing-structure actuating device actuates the biasing device support structure in the predetermined location in the outer tube. The fixing structure pursuant to the preferred embodiment is a spring-retainer structure which is fixed in a rotational sense to the spring stem of the spring stem-wedge-rod structure, and is fixed to the inner tube. The inner tube is initially pressed towards the outer tube to be slightly wider than the support surfaces, and this also effects the initial location of the expansion joint structure. The inner tube is then twisted, and this forces the threaded rod into the nut causing the wedge to expand the expansion members to lock the expansion joint structure. The inner tube is then manually compressed into the outer tube, and the tension rod is placed between the support surfaces for expansion to mount the tension rod between the surfaces. The spring force of the compressible coil spring remains essentially uniform during the installation process regardless of the overall length to which the tension rod is set.

Figure 1:
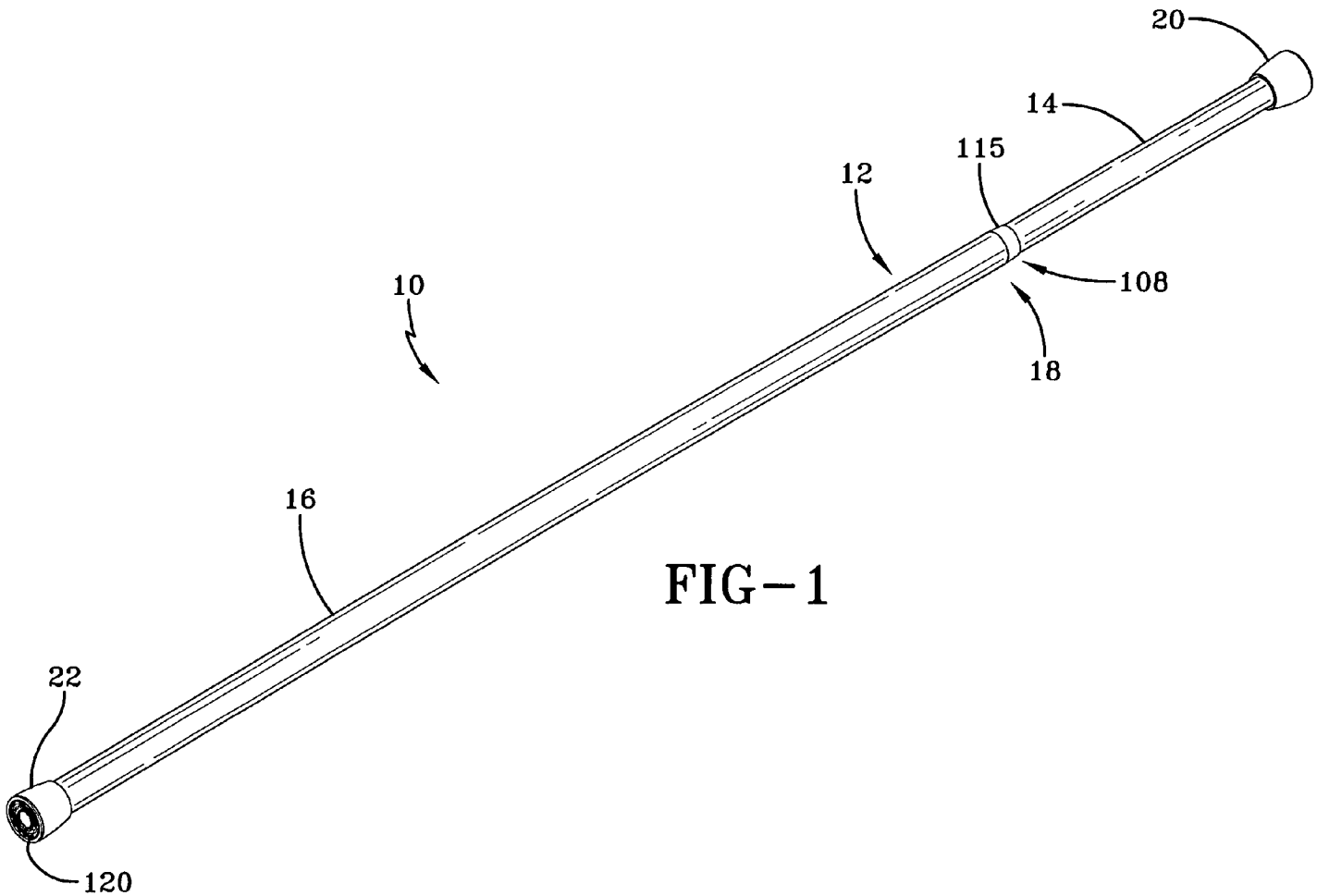
FIG. 1 is a perspective view of the tension rod in its preferred form according to the invention.
Figure 3:
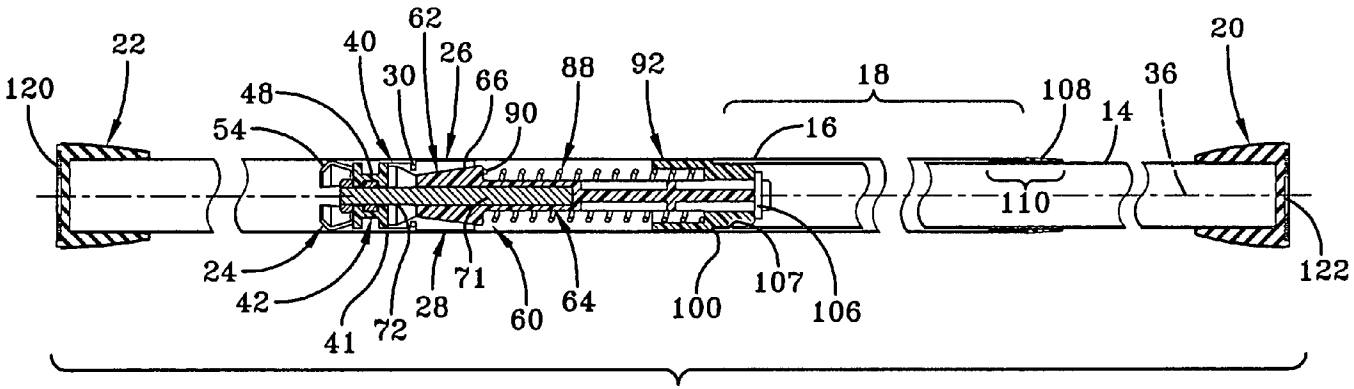
FIG. 3 is a lengthwise cross-sectional view of the tension rod shown in FIG. 1.

Referring to the drawings, FIG. 1 shows in perspective view a tension rod 10 according to the preferred form of the invention. Tension rod 10 has an outer assembly 12 comprising a relatively thinner inner tube 14 and a relatively wider outer tube 16 in close telescoping engagement as shown in FIG. 3 at location 18. An end cap or finial 20 fits on the free end of inner tube 14, and another end cap or finial 22 fits over the free end of outer tube 16. Plastic inserts 120 and 122 are disposed in the respective free ends of finials 20 and 22. A slide 108 is provided for a tight fit between tubes 14 and 16. Inserts 120 and slide 108 are discussed below.

The preferred embodiment of the invention basically requires adjusting the overall length by the relative pulling or pushing, twisting and moving towards each other of inner tube 14 and outer tube 16 with the structure described below to locate and fix a spring, and then to compress the spring for expanding the tubes against the opposing surfaces.

Figure 2:
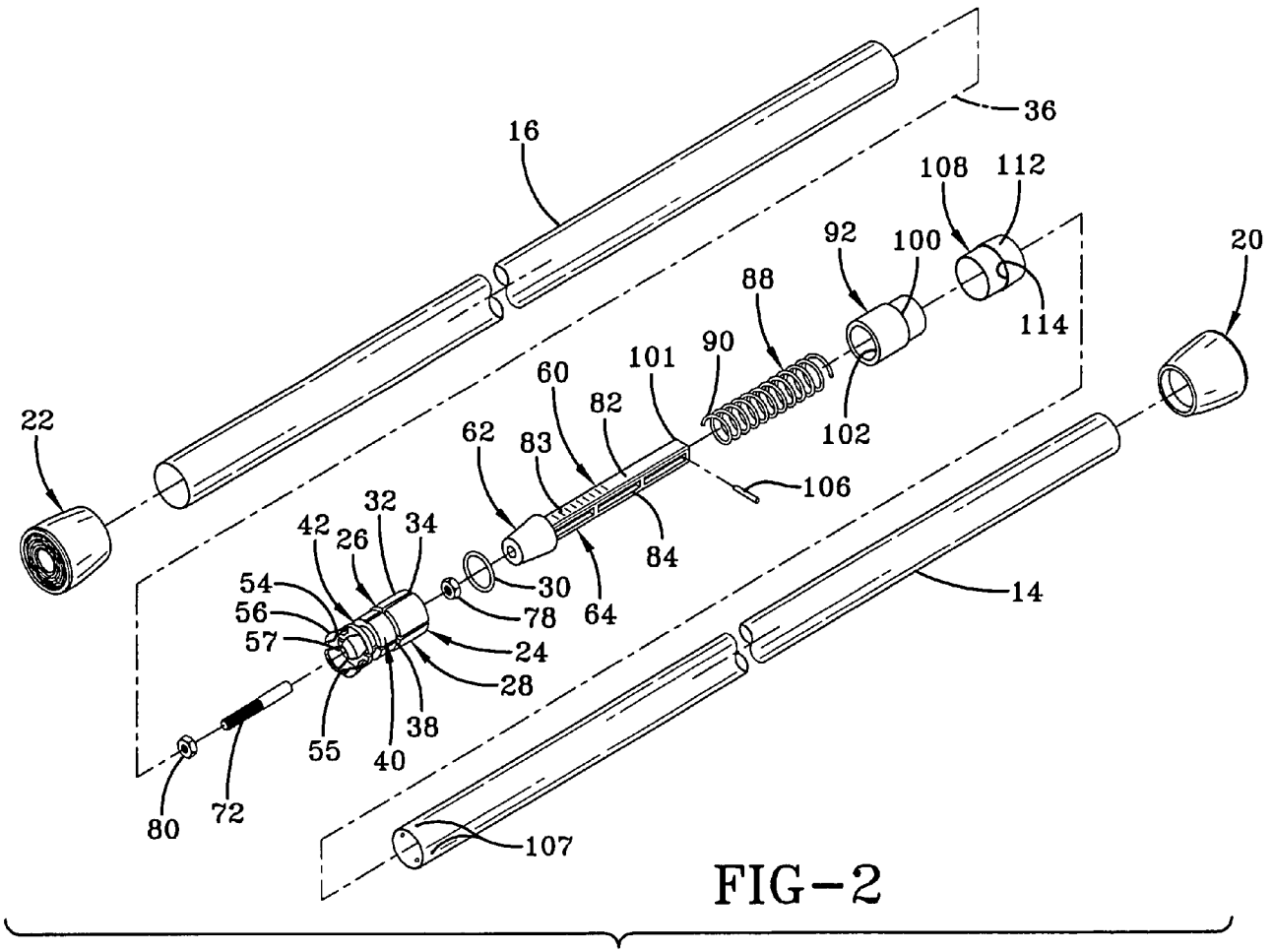
FIG. 2 is an exploded perspective view of the tension rod shown in FIG. 1.
Figure 4:
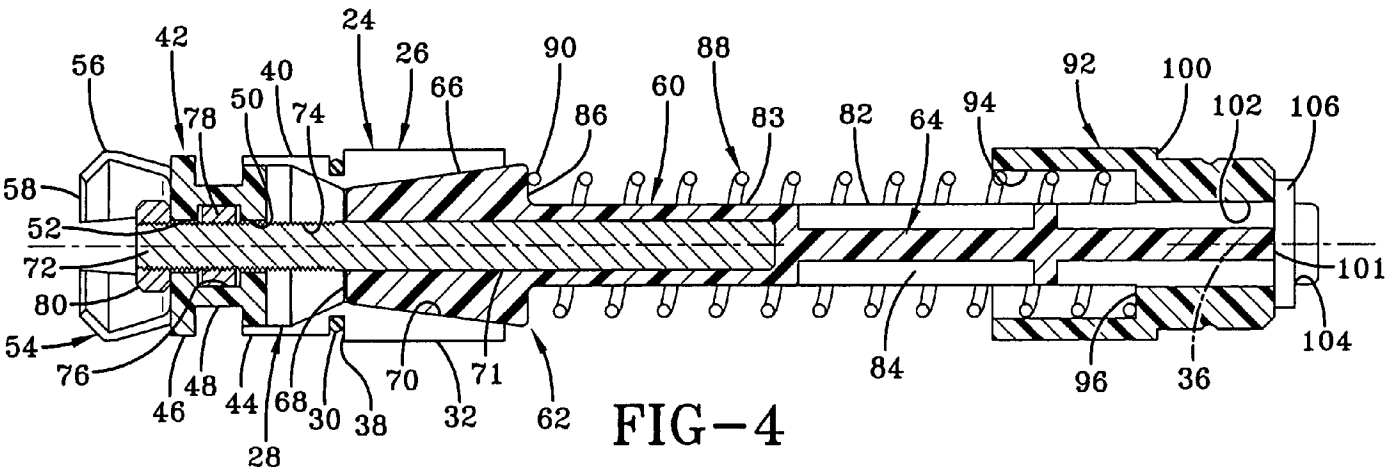
FIG. 4 is a longitudinal cross-sectional view of the subassembly including an expansion joint structure, a spring stem-wedge-rod structure, a compression spring and a spring retainer.
Figure 7:
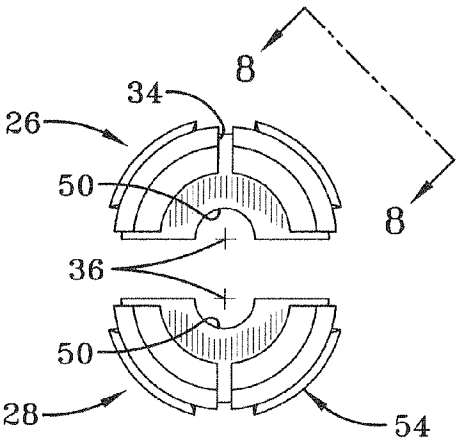
FIG. 7 is an end view of the parts shown in FIG. 6.
Figure 6:
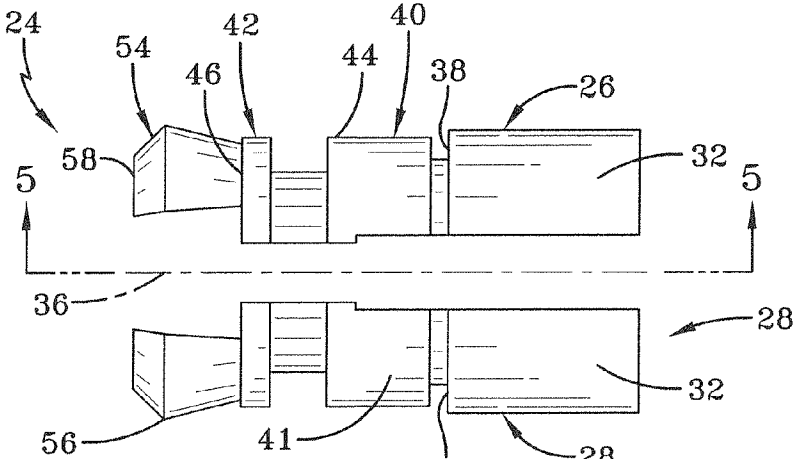
FIG. 6 is a side view of parts for forming an expansion joint structure according to the preferred embodiment of the invention.
Figure 5:
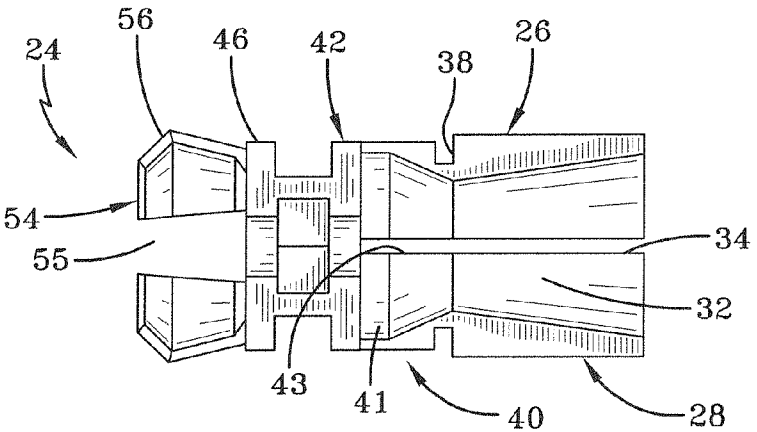
FIG. 5 is a side view of an expansion joint structure according to a preferred embodiment of the invention.
Figure 8:
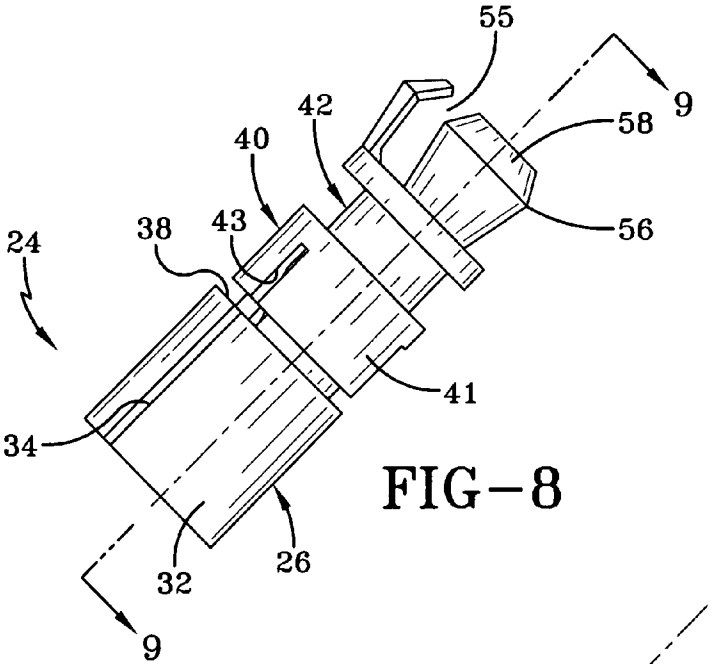
FIG. 8 is another side view of an expansion joint structure as shown in FIGS. 5-7.
Figure 9:
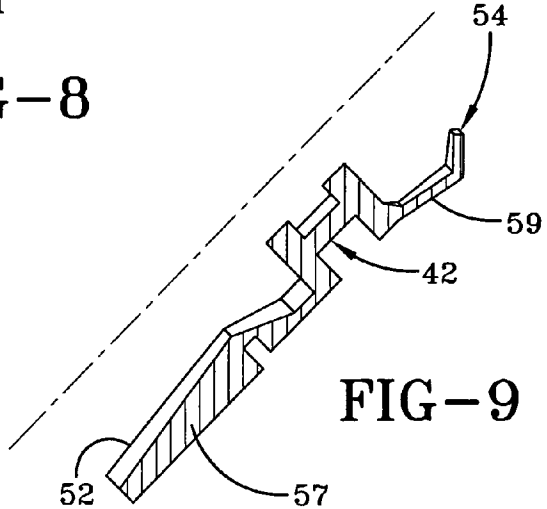
FIG. 9 is a view taken in the direction of arrows 9-9 in FIG. 8.

Viewing FIGS. 2-4 and particularly FIGS. 5-7, an expansion joint structure 24 is provided. Expansion joint structure 24 has preferably a pair of identical expansion halves 26 and 28 (FIG. 6), which could be hinged together with a living hinge or preferably are separate pieces. The material of structure 24 is preferably molded polypropylene. Expansion halves 26 and 28 are held together by an O-ring 30 which could be a flexible plastic or a resilient metal such as stainless steel. Expansion joint structure 24, considered as an internal unit when joined by O-ring 30, includes a set of expansion members 32 which when assembled form a generally cylindrical end portion. Since expansion joint structure 24 is being described as an integral unit even though it has to separate halves, slits as described below include the slits 34 (shown expanded in FIG. 6) between halves 26 and 28. Expansion members 32 are divided by a series of lengthwise slits 34 (FIGS. 2, 5) to render expansion members 32 expandable relative to a longitudinal axis 36 of tension rod 10. Expansion joint structure 24 has an annular groove or recess 38 for receiving O-ring 30, and further has an intermediate generally cylindrical portion 40 which has members 41 which are extensions of expansion members 32 since lengthwise slits 34 extend into portion 40 as slits 43. Expansion joint structure 24 has a nut holder 42 extending from the end of intermediate portion 40. As shown most clearly in FIG. 4, nut holder 42 has a pair of longitudinally-spaced disk portions 44 and 46 which are connected lengthwise by a cylindrical section 48. Disk portions 44 and 46 have aligned cylindrical holes 50 and 52 which have relatively narrow radii, and nut holder 42 has a relatively wide radius for reasons explained below. Extending radially and longitudinally at an incline relative to longitudinal axis 36 is a set of four expansion leaves 54. Leaves 54 are divided by longitudinal slits 55 each having an outer, rounded ridge 56. and each has an open end edge 58. Expansion members 32 have inner ribs 57 and leaves 54 each have inner, longitudinally extending ribs 59, as shown in FIG. 9, to prevent them from crunching upon the imposition of forces thereon as discussed below.

Expansion joint structure 24 is rotatably connected to a spring stem-wedge-rod structure 60. Spring stem-wedge-rod structure 60 has a longitudinal axis which is the same as axis 36 of tension rod 10 and includes a wedge portion 62 and a stem portion 64, shown most clearly in FIG. 4. Stem portion 64 preferably has a partially rounded, square cross section at its midsection and has a square cross section at its end distal expansion member 32 to prevent it from turning in a square receptacle in which it is placed. Wedge portion 62 has a frusto-conical outer surface 66 tapering towards longitudinal axis 36 at an end surface 68 of spring stem-wedge-rod structure 60, and respective inner surfaces 70 of each of expansion members 32 of expansion joint structure 24 are curved, tapered and thus together configured to engage most of outer surface 66 of wedge portion 62.

Wedge portion 62 of spring stem-wedge-rod structure 60 has a closed, unthreaded bore 71 extending along longitudinal axis 36 from a free end surface 68 of wedge portion 62. Disposed within and extending from closed bore 71 is a partially threaded rod 72 which extends through an unthreaded open bore 74 of cylindrical portion 40, as well as through unthreaded bores 50 and 52 of disk portions 44 and 46. Partially threaded rod 72 is fixed to and part of spring stem-wedge-rod structure 60 such as by being molded in place. The portion of rod 72 which extends into wedge portion 62 and stem portion 64 is not threaded since it is molded with portions 62 and 64. Each of bores 71, 74, 50 and 52 is of the same diameter, which is wider than the diameter of threaded rod 72, and has as their coincident longitudinal axis, longitudinal axis 36. A bore 76, wider than either of bores 50 and 52 of nut holder 42, is disposed between disk portions 44 and 46, and a threaded hex nut 78, through which rod 72 is threaded, is located in bore 76. Another nut or fixed end portion 80 is disposed on the end of threaded rod 72. The outer diameter or outer dimension of fixed nut or end portion 80 is larger than the diameter of bore 52, and is provided to prevent the withdrawal of threaded rod 72 (and the entire spring stem-wedge-rod structure 60) from being withdrawn through hole 52 of expansion joint structure 24.

Stem portion 64 of spring stem-wedge-rod structure 60 has opposing, flattened outer surfaces 82 on opposite portions of stem portion 64 distal wedge portion 62, and opposing curved portion 83 (curved about longitudinal axis 36) to assist in keeping the coil spring discussed below in proper position symmetrical about stem portion 64. There are another pair of opposing surfaces of stem portion 64, namely opposing, recessed ribbed surfaces 84, and the widest portion between surfaces 84 are each less than the outer portion of an inner end surface 86 (proximate stem portion 64) of wedge portion 62. Spring stem-wedge-rod structure 60 is advantageously made from nylon.

A compression spring 88 is provided on stem portion 64 of spring stem-wedge-rod structure 60, and an end coil 90 of spring 88 abuts inner end surface 86 of wedge portion 62. Compression spring 88 is preferably zinc-coated spring steel having a wire diameter of 0.062 inches, a pitch of 0.25 inches and having a 25 pound force when compressed two inches.

A spring retainer 92 is provided for a number of purposes, including when coupled to inner tube 14 as described below, to operate spring stem-wedge-rod structure 60, and to hold spring 88 in position to effect the provision of tension to tension rod 10. Spring retainer 92 includes a spring-receiving bore 94 having a shoulder or abutment 96 as a stop for spring 88, and an exterior abutment 100 for engaging the end of inner tube 14. An end portion 101 of stem portion 64 extends through an open bore 102 of spring retainer 92, and a transverse hole 104 in end portion 101 receives a set pin 106 for retaining spring retainer 92 on spring stem-wedge-rod structure 60. Spring retainer 92 is preferably constructed as molded nylon Inner tube 14 has a series of inwardly extending dimples 107 (FIGS. 2 and 3) for fixing inner tube 14 to spring retainer 92. This enables the twisting of inner tube 14 and the turning of spring stem-wedge-rod structure 60, and the longitudinal forward and rearward movement of spring stem-wedge-rod structure 60 and the compression and expansion of spring 88 with like movements of inner tube 14.

Shower rod retainer sleeve 108, described hereinafter, is provided at part of an interface 110 (FIG. 3) between the overlapping interior portions of inner tube 14 and the non-free end portion of outer tube 16. Sleeve 108 is dimensioned to fit snugly against both inner tube 14 and outer tube 16 as shown at interface 110. An expanded open end portion 112 of sleeve 108 defines a shoulder 114 (FIG. 2) for being engaged by the end of outer tube 16 to retain the relative positions of inner tube 14 and outer tube 16 in various locations in which they are set, but to allow linear movement of tubes 14 and 16 upon manual pressure as described later. Sleeve 108 also has an exterior transition 115 (FIG. 1) to provide a smoother surface across the free end of outer tube 16 where it surrounds inner tube 14, to avoid a sharp abutment at that place. Sleeve 108 is preferably made from molded polypropylene.

Finial 20 of inner tube 14 and finial 22 of outer tube 16 can be made from stainless steel, as are inner tube 14 and outer tube 16, or of an appropriate plastic, or rubber or an artificial rubber. Finials 20 and 22 are dimensioned to slide on inner tube 14 and outer tube 16, respectively, with a tight fit. The ends of finials 20 and 22 are recessed at respective recesses, and plastic inserts 120 and 122, respectively, are press fit in the respective recesses to avoid marring the walls or other support surfaces to which tension rod 10 is affixed. Finials 20 and 22 should be made from a non-marring material, and suction cups could be used for walls such as ceramic tile walls or smooth metal walls.

In order to operate tension rod 10, one simply manually pulls inner tube 14 relative to outer tube 16 to a distance of about 1.25 inches wider than the distance between the walls where (for a compression spring as set forth above as a preferred spring) tension rod 10 is to be affixed. Ridges 56 of expansion leaves 54 initially fix expansion joint structure and spring stem-wedge-rod structure 60 in place in outer tube 16. The manual force required to do this can be done easily by older children and adults. The person adjusting rod 10 then twists inner tube 14 relative to outer tube 16 without changing the overall length of tension rod 10 to drive partially threaded rod 72 (and the spring stem-wedge-rod structure) partly through hex nut 78. This is an easy operation to perform. This causes wedge portion 62 to engage and force outwardly expansion members 32 to bind expansion joint structure 24 firmly in place inside of outer tube 16. The user then moves inner tube 14 further inside of outer tube 16 by a small amount (1.25 inches was discussed above), and tension rod 10 is placed between the opposing walls or other support structure. The person then releases inner tube 14 and allows compression spring 88 to bias tubes 14 and 16 against the support surfaces. Tension rod 10 is then in position for use as a curtain rod, a clothes rod or any other purpose. To remove tension rod 10 from between two support surfaces where it is positioned, one applies linear compressive force to outer tube 16 and inner tube 14 to enable them to be removed from between the support surfaces, and once removed tension rod 10 can be reused following the foregoing procedure.

In some instances, it is desirable to change the force load of compression spring 88. For example, a strong force load would be desirable for walls with strong support such as tiled walls, whereas a lower force load may be advantageously applied for weaker walls such as dry walls. This is easily accomplished by lessening the separation of tubes 14 and 16 for drywalls or other weaker walls to less than 1¼ inch prior to installment of tension rod 10, but to maintain it at 1¼ inches for stronger walls.

Figure 10:
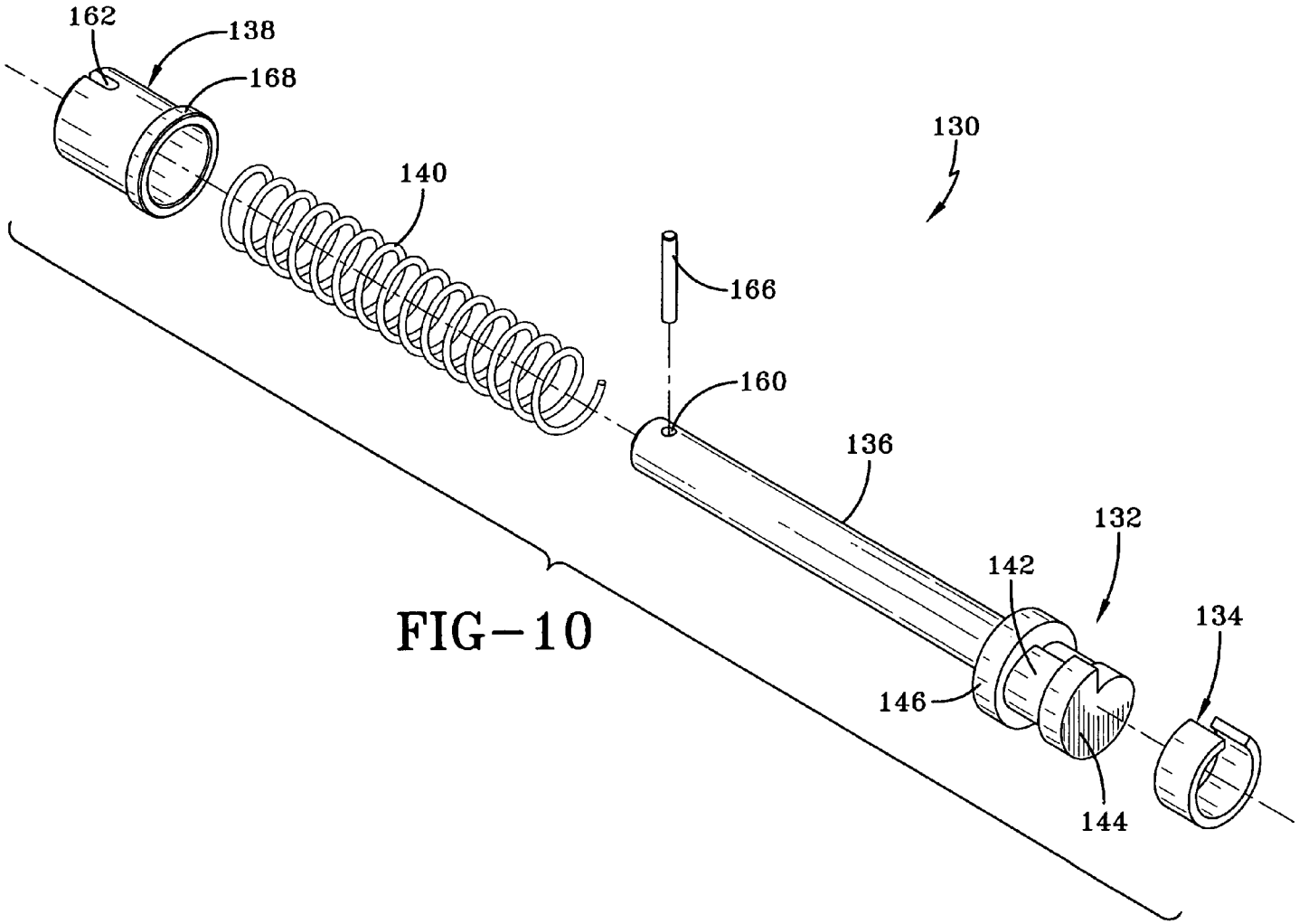
FIG. 10 is an exploded perspective view of another embodiment of an expansion joint structure according to the present invention incorporating a cam assembly.
Figure 11:
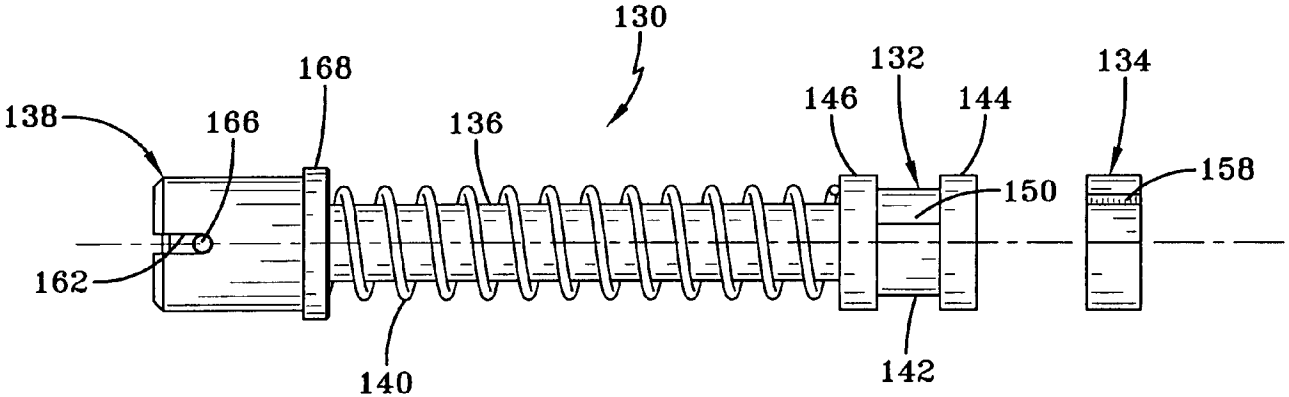
FIG. 11 is a side view of an assembled expansion joint structure as shown in FIG. 10, with a cam collar shown separately.
Figure 12:
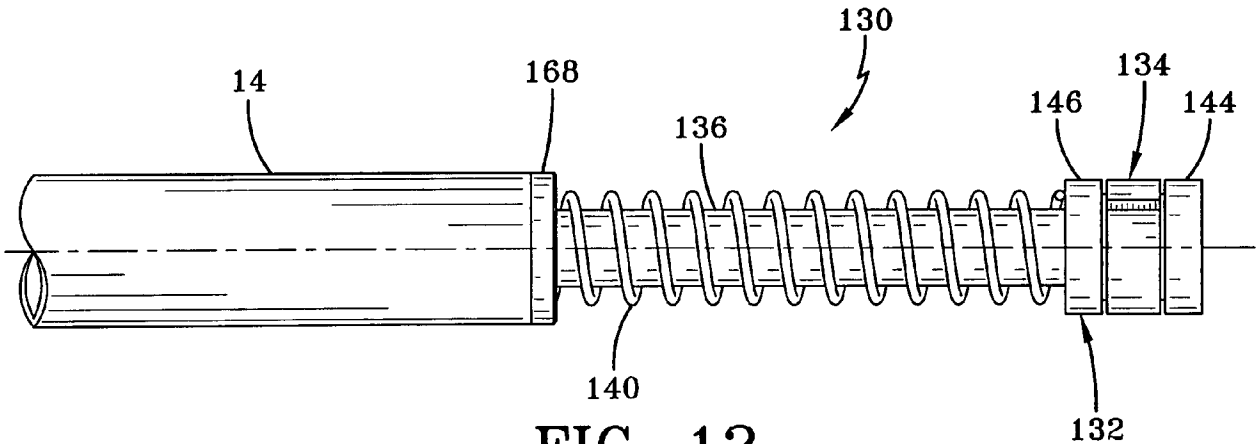
FIG. 12 is a side view of an expansion joint structure as shown in FIGS. 10 and 11 assembled in an inner tube of a tension rod according to the latter embodiment of the invention.
Figure 13:
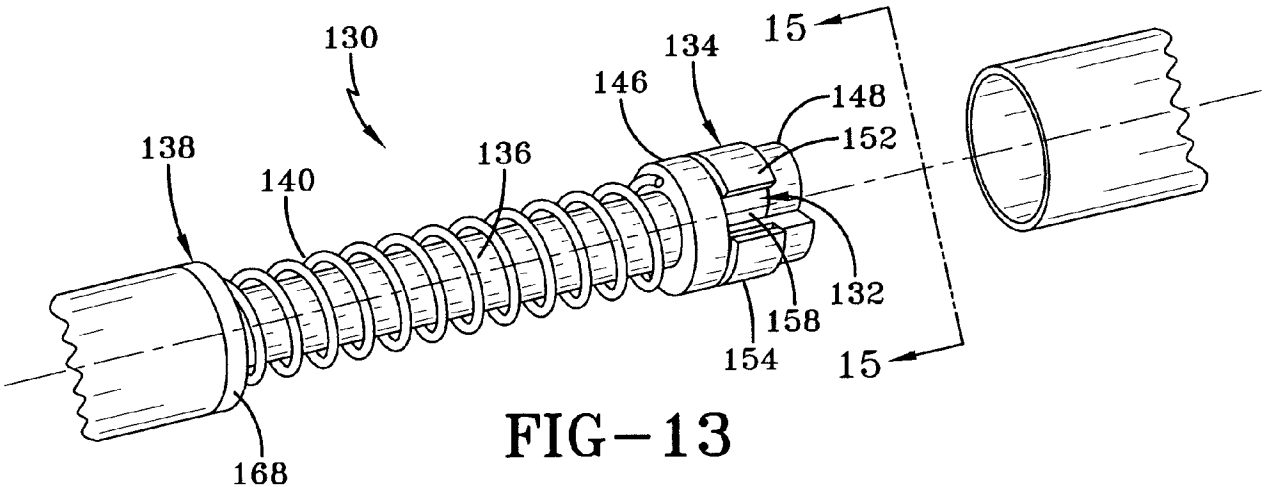
FIG. 13 is a perspective view of a part of the structure shown in FIGS. 10-12, shown prior to insertion thereof into a tube forming part of the tension rod.
Figure 14:
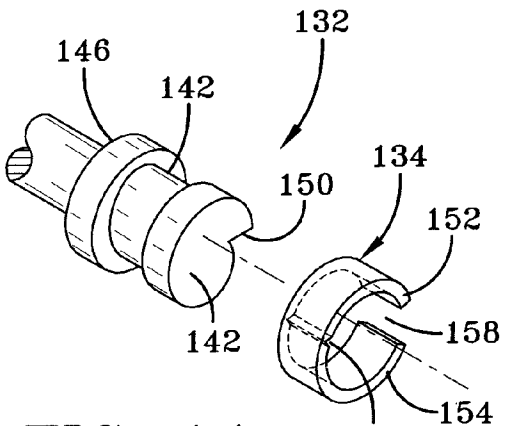
FIG. 14 is a perspective view of the part of the embodiment shown in FIGS. 10-13, with a cam roller shown separately.
Figure 15:
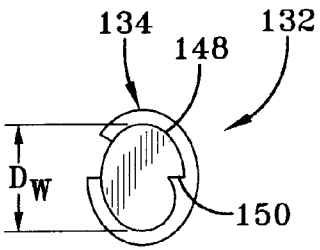
FIG. 15 is an end view of the structure shown in FIG. 14 exclusive of the cam collar.
Figure 16:
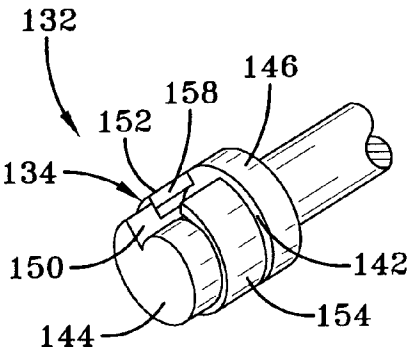
FIG. 16 is a perspective view of the cam assembly shown in FIGS. 10-15.

Alternatives are available instead of expansion joint structure 24 and spring stem-wedge-rod structure 60 which are used to lock inner tube 14 and outer rube 16 in place and to allow the compression of compression spring 88 in order to mount tension rod 10 between two support surfaces. One example is a cam expansion structure incorporating a cam assembly as shown in FIGS. 10-16. FIGS. 10-13 show a cam fixing structure 130. Cam fixing structure comprises a cam assembly 132, a cam collar 134, a stem portion 136, a spring retainer and anchor structure 138 and a compression spring 140. Referring to FIGS. 10-12 and particularly to FIGS. 13-16, cam assembly 132 comprises a cam body 142, a free end wall 144 and an inner wall 146. Cam body 142 has a long cross dimension $D_w$ (FIG. 15), which is formed by an expanded portion 148, which has an abutment surface 150 at the termination of expanded portion 148.

Cam collar 134 has a C-shape, and comprises a first section 152, a second section 154 and a living hinge 156 connecting sections 152 and 154. A gap 158 separates the free ends of sections 152 and 154. Cam collar 134 is held on cam body 142 by free end wall 144 and inner wall 146.

Stem portion 136 is preferably integral with cam assembly 132, and is cylindrical in shape for passing through compression spring 140 which is loosely wound around it. Stem portion 136 is fixed in spring retainer and anchor structure 138. The latter is accomplished by the structure shown in FIGS. 10 and 11. Spring retainer and anchor structure 138 has opposing open slits 162. Free end portion 160 has a transverse hole 164 extending therethrough. A set pin 166 extends through hole 162, and its length is such that is extends through slits 162 as shown in FIG. 11. Therefore stem portion 136 cannot rotate.

Spring retainer and anchor structure 138 has a spring retainer and anchor structure 138. An integral collar 168 is provide for cooperating with inner wall 146 to contain compression spring 140 therebetween, and for assisting in retaining cam fixing structure 130 in place in inner tube 14. Inner tube 14 has dimbles 107 referred to earlier for holding spring retainer and anchor structure 138 fixed to inner tube 14. Therefore, any movement of inner tube 14 is reflected in the movement of spring retainer and anchor structure 138.

In order to mount tension rod 10 having cam fixing structure 130 incorporated therein between opposing support surfaces, the length of tension rod 10 is initially adjusted so that it is slightly larger than the distance between the opposing support surfaces, for example 1.25 inches if compression spring 140 has characteristics like those of compression spring 88 described earlier Inner tube 14 is then twisted relative to outer tube 16. This causes the rotation of spring retainer and anchor structure 138, causing anchor structure 138 to rotate stem portion 136 and cam 132 to rotate. The rotation of cam 132 brings abutment surface 150 into engagement with a free end of cam collar 134, and cam 132 forces the outer surface of cam collar 134 into engagement with the inner surface of outer tube 16. The latter engagement locks cam fixing structure 130 and inner tube 14 in place. The user then contracts inner tube 14 and outer tube 16 enough to fit tension rod 10 between the support surfaces, and the tubes are then released to enable compression spring 140 to force inner rod 14 and outer rod 16 in place between the support surfaces.

The tension rod according to the invention is effective in operation and can be manufactured and assembled using ordinary manufacturing operations. The inventive tension rod can easily be operated and provides strong support when used between vertical walls or other support surfaces.

The present invention in its preferred embodiment is easy to operate and attractive in appearance. To mount the tension rod between a pair of opposing walls, one simply adjusts the length to a short distance wider than the walls, twists the inner rod by a small amount, and compresses the rods against a spring with a uniform spring force. There are no openings in the respective tubes so the internal working components are not visible. The free ends of the tubes are covered with finials.

Although the tension rod has been described for use between vertical support surfaces, it could be used in other situations as between a ceiling and a floor. For example, the inventive tension rod could be used as a support post from which shelves extend as in a bathroom or kitchen.

The invention has been described in detail with emphasis on its preferred embodiment, but variations and modifications may occur to those skilled in the art from the description set forth above and from the appended claims.

I claim:

1. A tension rod for being mounted between opposing support surfaces separated by a distance, said tension rod having a longitudinal axis and comprising:

an outer tube;

an inner tube disposed partially within said outer tube in a telescoping arrangement, said inner tube having an inner end disposed within said outer tube;

a compressible biasing device for establishing a tension force for urging said inner tube apart from said outer tube, said compressible biasing device comprising a spring;

a biasing device support structure being initially movable in said outer tube and activatable to be fixed at a predetermined location within said outer tube;

a fixing structure for being actuated in response to twisting of said inner tube about the longitudinal axis to activate said biasing device support structure and fix said biasing device support structure at a predetermined location within said outer tube, said fixing structure comprising a pair of integral coaxial cylinders having axes coincident with the longitudinal axis said coaxial cylinders comprising:

an inner cylinder proximal said biasing device support structure and having a spring receiving bore for receiving a portion of said spring, said spring receiving bore having an abutment for serving as a stop for said spring, an external relatively wide diameter and a solid external surface devoid of any holes through said solid external surface; and an outer cylinder distal said biasing device support structure having both a relatively narrow diameter compared to said external relatively wide diameter and a solid external surface devoid of any holes through said solid external surface, said inner cylinder and said outer cylinder cooperating to define an exterior abutment for engaging said inner end of said inner tube; and a fixing-structure actuating device for actuating said biasing device support structure at the predetermined location within said outer tube in response to the twisting of said fixing structure about the longitudinal axis;

wherein the length of said tension rod is initially adjusted to be longer than the distance separating the support surfaces, said fixing-structure actuating device being movable to fix said biasing device support structure at the predetermined location within said outer tube, and to compress said inner tube into said outer tube to compress said biasing device between the support surfaces in a compressed state, and said inner and outer tubes being releasable from the compressed state to allow said biasing device to force said inner tube and said outer tube against the respective support surfaces to mount said tension rod between said support surfaces.

2. A tension rod according to claim 1 wherein said fixing-structure actuating device is fixed to said inner tube in a rotational sense about the longitudinal axis, and being rotatable in response to the twisting of said inner tube and said fixing structure about the longitudinal axis.

3. A tension rod according to claim 1 wherein said biasing device support structure comprises an outer tube engagement device for engaging an inner surface of said outer tube in response to the actuation of said fixing structure to fix said biasing device support structure at the predetermined location.

4. A tension rod according to claim 3 wherein said outer tube engagement device comprises at least one expansion member for engaging the inner surface of said outer tube in response to the actuation of said fixing structure to fix said biasing device support structure at the predetermined location.

5. A tension rod according to claim 4 wherein said at least one expansion member is a set of expansion members for being collectively moved against the inner surface of said outer tube in response to the actuation of said fixing structure to fix said biasing device support structure at the predetermined location.

6. A tension rod according to claim 2 wherein said biasing device support structure further comprises an initial locating device for initially locating said biasing device support structure within said outer tube in response to the initial adjustment of the length of said tension rod.

7. A tension rod according to claim 6 wherein said initial locating device is at least one resilient member for engaging an inner surface of said outer tube in response to the initial adjustment of the length of said tension rod to initially locate said biasing device support structure at the predetermined location.

8. A tension rod according to claim 7 wherein said at least one resilient member comprises a set of expansion leaves for engaging the inner surface of said outer tube in response to the initial adjustment of the length of said tension rod to initially locate said biasing device support structure at the predetermined location.

9. A tension rod according to claim 8 wherein said set of expansion leaves for engaging the inner surface of said outer tube comprises a set of resilient members extending in a longitudinal direction and forming a free end of said biasing device support structure, said set of resilient members being equidistant from said longitudinal axis and being pivotable with respect to said longitudinal axis.

10. A tension rod according to claim 1 and further including a control device for controlling the activation of said biasing device support structure, said biasing device support structure containing a part of said control device.

11. A tension rod according to claim 10 wherein said part of said control device is a threaded rod-receiving nut, and said biasing device support structure includes a nut holder for containing said threaded rod-receiving nut.

12. A tension rod according to claim 1, and further including a control device for controlling the activation of said biasing device support structure, and wherein said biasing device support structure is an expansion joint structure, said expansion joint structure being initially movable within said outer tube, said expansion joint structure comprising:

expansion leaves for initially locating said expansion joint structure in said outer tube in response to the initial movement of said inner tube with respect to said outer tube when said tension rod is being mounted between the opposing support surfaces;

expansion members for being collectively moved against an inner surface of said outer tube in response to the actuation of said fixing structure to fix said expansion joint structure at the predetermined location in said outer tube; and a nut holder for holding a part of said control device.

13. A tension rod according to claim 12 wherein said expansion joint structure comprises at least two separable expansion joint structure components, and said tension rod further includes a connecting member for connecting said expansion joint structure components to form said expansion joint structure.

14. A tension rod according to claim 13 wherein said connecting member is an O-ring, and said expansion joint structure includes an annular recess for receiving said O-ring.

15. A tension rod according to claim 1 wherein said biasing device support structure comprises an outer tube engagement device, and said tension rod further includes an activation device, said activation device including an expanding device for urging said outer tube engagement device against an inner surface of said outer tube to fix said biasing device support structure at the predetermined location.

16. A tension rod according to claim 15 wherein said expanding device is a wedge portion being widened from a narrow portion proximal an outer end of said outer tube to a wide portion proximal the inner end of said inner tube, said wedge portion moving towards the outer end of said outer tube in response to said wedge portion being actuated by said fixing structure to move said outer tube engagement device against the inner surface of said outer tube.

17. A tension rod according to claim 15 wherein said expanding device is a cam structure being rotatable in said outer tube, and having an outer tube engagement portion relatively close to the inner surface of said outer tube, said outer tube engagement portion engaging said outer tube engagement device to move said outer tube engagement device against the inner surface of said outer tube, in response to the rotation of said cam structure being actuated by said fixing-structure actuating device.

18. A tension rod according to claim 16 wherein said spring has a uniform spring force regardless of compression, and said fixing-structure actuating device is a spring stem-wedge-rod structure comprising a spring stem extending through said spring and being connected to said wedge portion, wherein said fixing structure urges said spring stem-wedge-rod structure towards said biasing device support structure to cause said wedge portion to move said outer tube engagement device against the inner surface of said outer tube, and sequentially compresses said spring.

19. A tension rod according to claim 18 wherein said biasing device support structure is an expansion joint structure comprising a nut holder for holding a thread-engagement nut, wherein said outer tube engagement device includes a set of expansion members, and wherein said spring stem-wedge-rod structure further comprises a threaded rod for being threaded into said thread-engaging nut, said spring stem-wedge-rod structure being twistable in response to actuation of said fixing structure actuating device to cause said wedge portion to move said expansion members against the inner surface of said outer tube.

20. A tension rod according to claim 19 wherein said set of expansion members are respectively radially movable relative to said longitudinal axis.

21. A tension rod according to claim 1 wherein said compressible biasing device establishes said tension force without changing a biasing force of said compressible biasing device.

22. A tension rod for being mounted between opposing support surfaces separated by a distance, said tension rod having a longitudinal axis and comprising:

an outer tube;

an inner tube disposed partially within said outer tube in a telescoping arrangement;

a compressible biasing device for establishing a tension force for urging said inner tube apart from said outer tube, said compressible biasing device comprising a compressible coil spring;

a biasing device support structure being initially movable in said outer tube and activatable to be fixed at a predetermined location within said outer tube, said biasing device support structure comprising an outer-tube engagement device for engaging the inner surface of said outer tube;

a fixing structure for actuating said biasing device support structure and fixing said biasing device support structure at a predetermined location within said outer tube, said fixing structure comprising a spring retainer fixed with respect to said inner tube and having spring-engaging structure in the form of a spring receiving bore for receiving a portion of said compressible coil spring, said spring retainer effecting the movement of said outer-tube engagement device against the inner surface of said outer tube in response to the twisting in a selected direction of said inner tube with respect to both said outer tube and the longitudinal axis, and said spring retainer compressing said compressible coil spring in response to the movement of said inner tube further into said outer tube; and a fixing structure actuating device being twistable in response to the twisting of said fixing structure about the longitudinal axis, to activate said biasing device support structure to fix said biasing device support structure at the predetermined location within said outer tube;

wherein the length of said tension rod is initially adjusted to be longer than the distance separating the support surfaces, said fixing structure actuating device being twistable to urge said at least one expansion member against the inner surface of said outer tube to fix said biasing device support structure at the predetermined location within said outer tube, and to compress said inner tube and into said outer tube in a compressed state to compress said biasing device between the support surfaces, and said inner and outer tubes being releasable from the compressed state to allow said biasing device to force said inner tube and said outer tube against the respective support surfaces to mount said tension rod between said support surfaces.

23. A tension rod according to claim 22 wherein said fixing structure actuating device is a spring stem-wedge-rod structure comprising a wedge portion having a relatively narrow end proximal an outer end of said outer tube and a relatively wide end proximal an inner end of said inner tube, a spring stem extending through said compressible coil spring and being fixed to said spring retainer in a rotational sense about the longitudinal axis, a threaded rod extending from said wedge portion and a thread-engaging nut; and said biasing device support structure comprises an expansion joint structure wherein said outer tube engagement device comprises a set of expansion members engageable by said wedge portion, and a nut holder for holding said thread-engaging nut; said spring retainer being fixed to said inner tube and in a rotational sense about the longitudinal axis to said spring stem, said spring retainer effecting the movement of said expansion members into engagement of the inner surface of said outer tube in response to the twisting of said inner tube with respect to said outer tube in the direction to effect said latter movement, and compressing said compressible coil spring without changing the spring force of said compressible coil spring in response to the moving of said inner tube further into said outer tube.

* * * * *